US006293318B1

(12) United States Patent
Schmidt et al.

(10) Patent No.: US 6,293,318 B1
(45) Date of Patent: Sep. 25, 2001

(54) EMPTYING STATION FOR BULK BAGS, AND PROCESS OF EMPTYING BULK BAGS IN THE STATION

(75) Inventors: Manfred Schmidt, Geinhausen; Jurgen Ohlemacher, Bad Vilbel; Johannes Ehrlich, Alzenau, all of (DE)

(73) Assignee: Degussa AG, Frankfurt (DE)

( * ) Notice: Subject to any disclaimer, the term of this patent is extended or adjusted under 35 U.S.C. 154(b) by 0 days.

(21) Appl. No.: 09/635,394

(22) Filed: Aug. 10, 2000

(30) Foreign Application Priority Data

Aug. 10, 1999 (DE) ..... 199 37 700

(51) Int. Cl.[7] ..... B65B 1/04

(52) U.S. Cl. ..... 141/330; 141/114; 141/329

(58) Field of Search ..... 141/329, 330, 141/19, 106, 114, 351; 222/88, 81, 148; 220/212, 495.06, 495.08, 495.1

(56) References Cited

U.S. PATENT DOCUMENTS 2,306,426 * 12/1942 Bundy .
3,348,738 * 10/1967 Hertlein .
3,948,402 * 4/1976 Schott, Jr. .
4,194,652 * 3/1980 Williamson et al. ..... 222/185
4,307,990 * 12/1981 Carlson ..... 414/412
4,527,716 * 7/1985 Hass et al. ..... 222/83.5
4,557,825 * 12/1985 Wittes et al. ..... 141/114
4,688,979 * 8/1987 Kupersmit ..... 414/403
5,405,053 * 4/1995 Zublin ..... 141/330
5,944,070 8/1999 Schmidt et al. ..... 141/114
6,213,315 * 4/2001 Forney et al. ..... 211/85.15

* cited by examiner

*Primary Examiner*—Gregory L. Huson
*Assistant Examiner*—Khoa D. Huynh
(74) *Attorney, Agent, or Firm*—Pillsbury Winthrop LLP

(57) ABSTRACT

This emptying station is suited for emptying contents from bulk bags, especially bulk bags containing particulate hazardous materials as their contents. The emptying station includes a bulk-bag receptacle body having a top opening and bottom outlet, a bulk-bag cutting subassembly in the receptacle body, a raisable and lowerable top closure, and a sealing structure. The cutting subassembly includes at least three cutters each having an associated blade facing upwards, with the cutters collectively arranged to define a pyramid having an apex, and puncture pin positioned at the apex to point upwardly. In operation, a bulk bag is suspended from the top closure, then lowered with the top closure to pass the bulk bag into the receptacle body and cause the substantially flat bottom of the bulk bag to be pieced by the puncture pin and cut by the blades of the cutters to start emptying contents from the bulk bags to the bottom outlet. The sealing structure seals gaps formed between inner surfaces of the side walls and the bulk bag to prevent dust from escaping through the top opening. As the bulk bag is emptied, the top closure continues to lower until the top closure is positioned in a closed state in the top opening. Spray nozzles are preferably arranged in the receptacle body for external and/or internal rinsing of the emptied bulk bag.

16 Claims, 4 Drawing Sheets

EMPTYING STATION FOR BULK BAGS, AND PROCESS OF EMPTYING BULK BAGS IN THE STATION

CROSS-REFERENCE TO RELATED APPLICATION

This application relates to German Application DE 199 37 700.6, filed Aug. 10, 1999, the disclosure of which is incorporated herein by reference.

BACKGROUND OF THE INVENTION

1. Field of the Invention

The invention relates to an emptying station for bulk bags, in particular for bulk bags containing particulate hazardous materials, such as cyanuric chloride. The emptying station of this invention is especially useful for emptying bulk bags in a dust-free, safe manner and for rinsing the emptied bags.

2. Description of the Related Art

Various devices are known for emptying bulk bags, which as referred to herein mean large packaging containers which have in particular a capacity of from 100 to 1000 kg and are made of single-ply or multi-ply sacking material. U.S. Pat. No. 5,944,070 discusses one such device, which is purportedly useful for preventing problems arising during emptying of a bulk bag comprising an inner sack and an outer sack. The emptying device comprises a double-tube structure having an inner tube and an outer tube, a holding device arranged centrally above the inner tube for receiving a bulk bag, a raisable and lowerable closing ring for closing the upper end of an annular gap formed by the inner and outer tubes of the double-tube structure, and gripping and pulling devices for gripping and pulling taut the discharge neck of the inner sack. In operation, a bulk bag is inverted and lowered so that its outlet neck is gripped and pulled into the inner tube. The tie of the discharge neck can then be untied to release the contents of the bulk bag into the inner tube. Although this device allows safe emptying of powder-form bulk material, such as cyanuric chloride, handling of bulk materials with this device is rather complex. Another drawback of the device disclosed in U.S. Pat. No. 5,944,070 is that no provision is made for rinsing the emptied bulk bag before disposal of the emptied bulk bag.

It is also known in the art to cut open the bottom of a bulk bag suspended from a carrier means by lowering the bulk bag onto an opening device to thereby empty the bulk bag. The opening device consists of commercially available cutters known as pyramid cutters. At least three cutters are used in the opening device, and in the case of bulk bags of substantially rectangular cross section, preferably four cutters are used. The cutters are arranged in a pyramid with their blades coming together at the top to form an apex of the pyramid. A pin is positioned at the pyramid apex for piercing the bottom of a bulk bag lowered onto the opening device. The pyramid cutters are conventionally arranged in a bulk bag receiving means provided with an outlet. During the opening operation, the bulk bag is lowered through a top opening of the bulk bag receiving means until the bulk bag is pierced then cut by the pin and cutters, respectively. During the emptying operation, a stationary rubber sleeve arranged between the bulk bag and the receiving means functions to reduce the amount of dust escaping through the top opening. The rubber sleeve is constructed as an inverted bowl or as a cylindrical element. However, the rubber sleeve is only partially effective, making devices equipped with the rubber sleeve unsatisfactory for emptying bulk bags filled with hazardous materials. Such emptying stations also lack means for rinsing out the bulk bag with a liquid rinsing agent immediately after emptying thereof. The absence of an effective rinsing means allows contents of the bulk bag to remain adhered to the sack wall after the emptying operation is complete, since no rinsing means is provided for dissolving or rinsing the residual contents away.

SUMMARY OF THE INVENTION

Accordingly, it is an object of the present invention to provide a bulk-bag emptying station which is suitable for safe, dust-free emptying of contents, especially hazardous materials, from bulk bags.

In accordance with the principles of this invention, the above other objects are attained by the provision of a bulk-bag emptying station for emptying bulk bags having suspenders. The station comprises a bulk bag receptacle body comprising side walls. The side walls preferably form a box having a rectangular or square cross section and a sufficient height and volume to receive the bulk bag and suspenders thereof while leaving gaps between inner surfaces of the side walls and the bulk bag received therein. The receptacle body has a top opening configured to receive the bulk bag and a bottom outlet configured to dispense contents of the bulk bag. A bulk-bag cutting subassembly is accommodated in the bulk bag receptacle body and comprises at least three cutters and a puncture pin. Each of the cutters has an associated blade facing upwards, with the cutters collectively being arranged to define a pyramid having an apex, with the puncture pin positioned at the apex to point upwardly. The emptying station further comprises a top closure raisable into a receiving state in which the top closure is spaced from the receptacle body and lowerable into a closed state in which the top closure is received in the top opening. The top closure is engageable with the suspenders of the bulk bag so that raising and lowering of the top closure moves the bulk bag, when engaged to the top closure, out of and into contact with the cutting subassembly. A sealing structure positioned on the inner surfaces of the side walls of the receptacle body seals the gaps formed between the side walls and the bulk bag when the filled bulk bag is received in the receptable body.

It is another object of the present invention to provide a bulk-bag emptying station which allows for dust-free emptying of hazardous materials from bulk bags and, subsequent to the emptying operation, allows for rinsing of the inner sack and optionally the outside of the outer sack. In accordance with the principles of this invention, the above and other objects are attained by providing the emptying station with one or more spray nozzles and one or more supply lines for supplying a rinsing agent to the spray nozzles. The spray nozzles are preferably positioned inside the pyramid, so that subsequent to opening a bulk bag with the cutting subassembly and emptying of the opened bulk bag, the inside of the bulk bag can be washed. Spray nozzles can also be positioned outside of the pyramid of cutters to rinse the outside of the bulk bags.

It is still another object of the present invention to provide a process of emptying and cleaning a single- or multi-ply bulk bag having a substantially flat bottom and suspenders, especially bulk bags having hazardous contents, such as cyanuric chloride.

In accordance with the principles of this invention, the above and other objects are attained by the provision of a process in which an emptying station is provided, the emptying station comprising a bulk-bag receptacle body including side walls and having a top opening and bottom outlet, a bulk-bag cutting subassembly accommodated in the receptacle body and comprising at least three cutters and a puncture pin, a raisable and lowerable top closure, and a sealing structure positioned on the inner surfaces of the side walls of the bulk bag receptacle body. The cutters each have an associated blade facing upwards and the cutters are collectively arranged to define a pyramid having an apex, with the puncture pin positioned at the apex to point upwardly. The suspenders of the bulk bag are coupled to the top closure, and the bulk bag is suspended from the top closure and spaced from the bulk bag cutting subassembly. The top closure and the bulk bag coupled thereto are then lowered so that the substantially flat bottom surface of the bulk bag is pierced by the puncture pin and cut by the blades of the cutters to begin emptying of the contents from the bulk bags. At the same time, the sealing structure seals the gaps formed between the inner surfaces of the side walls and the bulk bag. In this manner, the sealing structure prevents dust from escaping through the top opening, which is not yet sealed by the top closure. As the contents empty from the bulk bag, the top closure continues to move downward into a closed state in which the top closure is received in the top opening. Subsequent to emptying the bulk bag, the inside of the emptied bulk bag can optionally be rinsed with a rinsing agent sprayed from internal spray nozzles.

Other objects, aspects and advantages of the invention will be apparent to those skilled in the art upon reading the specification and appended claims which, when read in conjunction with the accompanying drawings, explain the principles of this invention.

BRIEF DESCRIPTION OF THE DRAWINGS

The accompanying drawings serve to elucidate the principles of this invention. In such drawings.

DETAILED DESCRIPTION OF THE INVENTION

Figure 1:
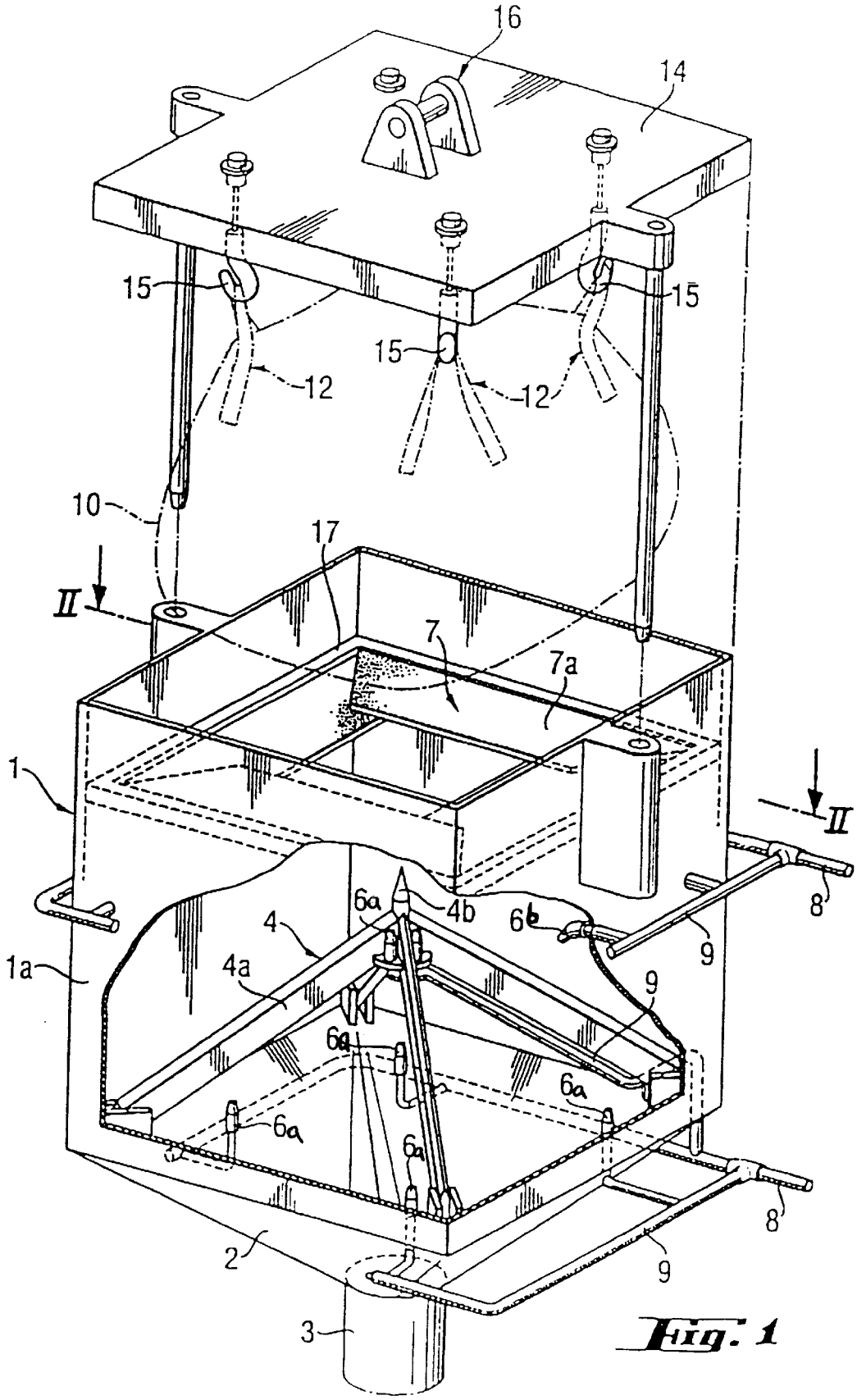
FIG. 1 is a schematic perspective view of an emptying station in a receiving state according to an embodiment of this invention.
Figure 2:
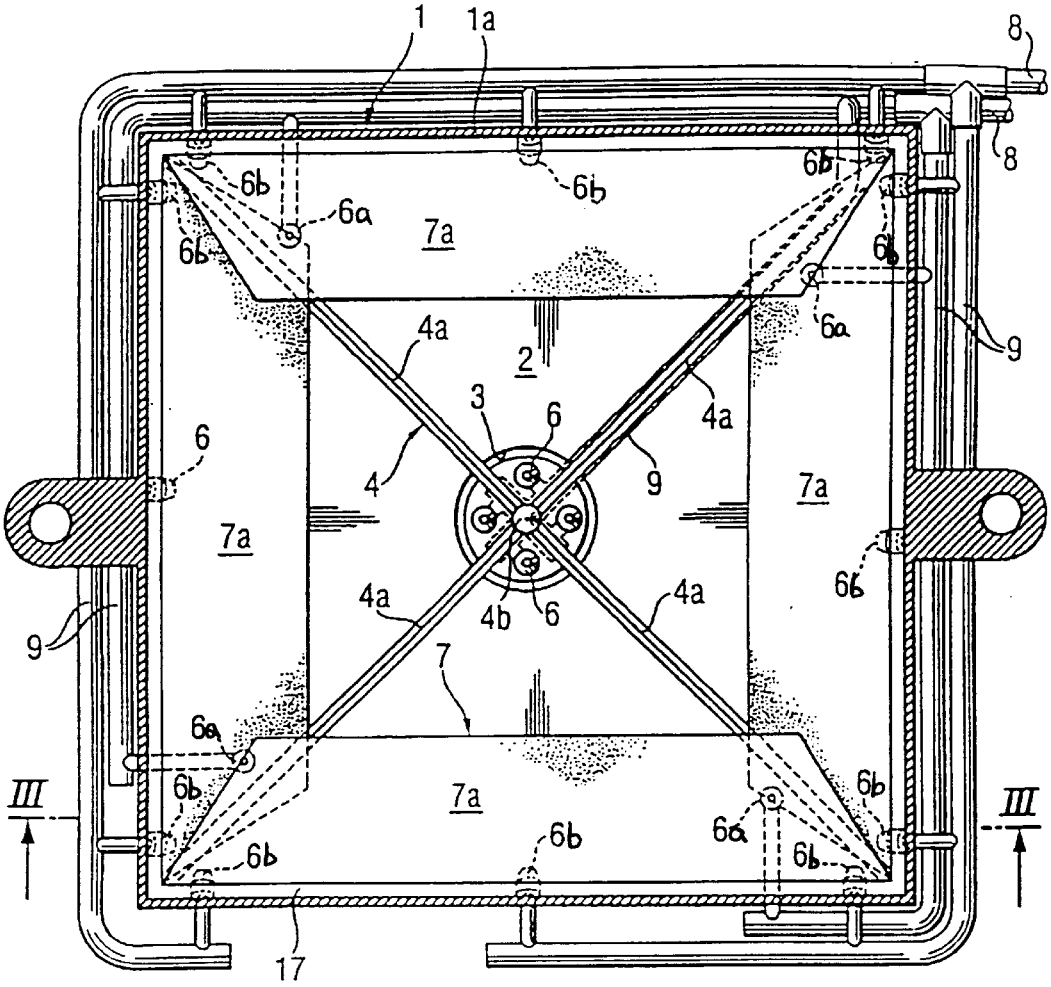
FIG. 2 is a schematic sectional view taken along plane II—II of FIG. 1, showing the interior of a receptacle body of the emptying station.

Referring now more particularly to the drawings, and in particular FIGS. 1 and 2, there is shown an emptying station designed to empty bulk bags, especially bulk bags for storage of particulate hazardous contents.

The emptying station comprises a bulk-bag receptacle body 1, which in the illustrated embodiment has four side walls 1*a* that collective form a box with a square cross section. Although the receptacle body 1 is illustrated as having a box shape, it should be understood that the receptacle body 1 may undertake other shapes having fewer or more than four side walls 1*a*. For example, the side walls can be rounded to form a circular cross section. Similarly, the side walls 1*a* may have different lengths, such that the receptacle body 1 can have, for example, a rectangular cross section. It is particularly expedient to form the receptacle body 1 as a box having a rectangular or square cross section, since bulk bags 10 are commercially available with square and rectangular cross sections.

Attached at the bottom surfaces of the side walls 1*a* is a funnel 2 and a bottom outlet 3, which is shown as a pipe. The bottom outlet 3 is positioned centrally relative to the funnel 2. The funnel 2 is preferably sealed at one end with the side walls 1*a* and at the other end with the outlet 3 to prevent escape of the particular contents of the bulk bags 10 during emptying of the bulk bags 10. During emptying, this pipe connection is appropriately connected directly to, for example, a feed pipe connection of the reactor in which the bulk bag 10 contents are to undergo further reaction by means of, for example, a hose-type coupling.

Accommodated inside of the receptacle body 1 is a bulk-bag cutting subassembly, which is generally designated by reference numeral 4. The cutting subassembly comprises at least three cutters, and in the illustrated embodiment four cutters 4*a*. Each of the cutters 4*a* has a respective blade (unnumbered) facing upwards. The cutters (also referred to herein as pyramid cutters) 4*a* are collectively arranged in the lower half, preferably the lower quarter, of the illustrated box, to form a pyramid having a top apex. A piercing pin 4*b* is arranged at the apex of the pyramid. In the illustrated embodiment, the piercing pin 4*b* is oriented vertically. The number of cutters 4*a* provided preferably corresponds to the number of lower corners of the box defined by the side walls 1*a,* with each of the lower corners having a corresponding cutter 4*a* extending therefrom. If the walls 1*a* are curved to provide a round or circular cross section to the receptacle body 1, the cutting subassembly 4 preferably comprises at least three pyramid cutters spaced apart 120° from each other. The pyramid cutters 4*a* generally form an angle with the horizontal in the range of from 30° to 75°, in particular from 45° to 60°. The pyramid preferably has a height that is 0.5 to 2 times the width of the widest of the side walls 1*a*. The upwardly directed blades of the pyramid cutters 4*a* allow the entire area of the bottom of the bulk bag 10 lowered thereon to be cut open.

The emptying station further comprises a top closure 14 that is raisable into a receiving state (shown in FIG. 1) spaced from the bulk bag receptacle body 1 and lowerable into a closed state (shown in FIG. 3) in which the top closure 14 is received in the top opening of the receptacle body 1. The top closure 14 has a bottom surface with hooks 15 extending therefrom. On the upper surface of the top closure 14 is a carrier device 16 from which said top closure 14 is suspendable. When raised above the receptacle body 1 as shown in FIG. 1, suspenders 12 of the bulk bag 10 can be coupled to the hooks 15 to suspend the bulk bag 10 from the top closure 14. Conventionally, the suspenders 12 are holding straps or the like. In this manner, lowering and raising of the top closure 14 moves the bulk bag 10 suspended therefrom into and out of the receptacle body 1.

The height of the side walls 1*a,* measured from the base of the cutting subassembly 4, corresponds to at least the height of the bulk bag 10 and the outstretched suspenders 12. By providing the side walls 1*a* with a sufficient height, the entire filled bulk bag 10 can be accommodated in the receptacle body 1 and the top closure 14 can function as a lid, closing the top opening of the receptacle body 1. The cross section of the receptacle body 1 corresponds substantially to the cross section of the filled bulk bag 10, with an additional wall gap being present between the filled bulk bag 10 and the inner surfaces of the walls 1*a* to facilitate handling of the bulk bag 10 during raising and lowering operations.

To prevent dust from escaping from the receptacle body 1, the receptacle body 1 includes a sealing structure 7 for sealing the gaps between the bulk bag 10 and the side walls 1*a*. As referred to herein, the sealing structure 7 can include strips located uniformly at one height as shown in FIG. 1, or a plurality of sealing strips arranged at different heights on the side walls 1*a*. The sealing structure 7 can include a single-part sealing lip or multi-part sealing lips. In the case of emptying stations with rectangular box cross sections, such as illustrated in FIG. 1, a suitable sealing structure 7 comprises a sealing plate 7*a* of a flexible material fixed to a flange 17 on each of the side walls 1*a*. The material for making the sealing plates 7*a* can be made, for example, of one of more of the following: natural and/or synthetic rubbers; flexible plastics such as polyolefins and polyamides; and silicone-rubber. The sealing plates 7*a* are pressed downwards upon lowering of the bulk bag 10 and thus seal the gap due to their positioning and flexibility and elasticity.

The emptying station can optionally be equipped for rinsing the bulk bag 10 subsequent to emptying of the contents from the bulk bags 10. Rinsing is often necessary to ensure safe disposal of the emptied bulk bags 10, such as for bulk bags 10 filled with hazardous materials as its contents. Although most of the residual contents typically remain on the inside of the bulk bags 10, it is also sometimes desirable to rinse the outsides of the bulk bags 10 subsequent to emptying, especially where hazardous material may adhere to the outside of the bulk bags 10. In order to perform these rinsing operations, the emptying station can be provided with one or more interior spray nozzles 6*a* and exterior spray nozzle 6*b,* together with a supply line or supply lines 9 for supplying a rinsing agent. Interior nozzles 6*a* arranged inside the pyramid of cutters 4*a* are useful for rinsing the insides of the bulk bags 10 subsequent to emptying. The interior spray nozzles 6*a* inside the pyramid of cutters 4*a* are arranged below imaginary planes in which the cutter blades lie. Although a plurality of interior spray nozzles 6*a* are illustrated, it is understood that only a single spray nozzle (or a number different than that illustrated) can be equipped in the emptying station. The interior nozzles 6*a* are preferably oriented in such a way that the entire inner sack may be reliably rinsed out. The exterior spray nozzle 6*b* are positioned outside of the pyramid defined by the cutters 4*a,* and serve to rinse the outside or exterior of the bulk bags 10. As in the case of the interior spray nozzles 6*a,* one or a plurality of exterior spray nozzles 6*b* can be used. The supply lines 9 for the one or more spray nozzles are appropriately located inside the pyramid (or outside the pyramid for the external spray nozzles 6*b*) and preferably beneath one of the cutters.

Figure 3:
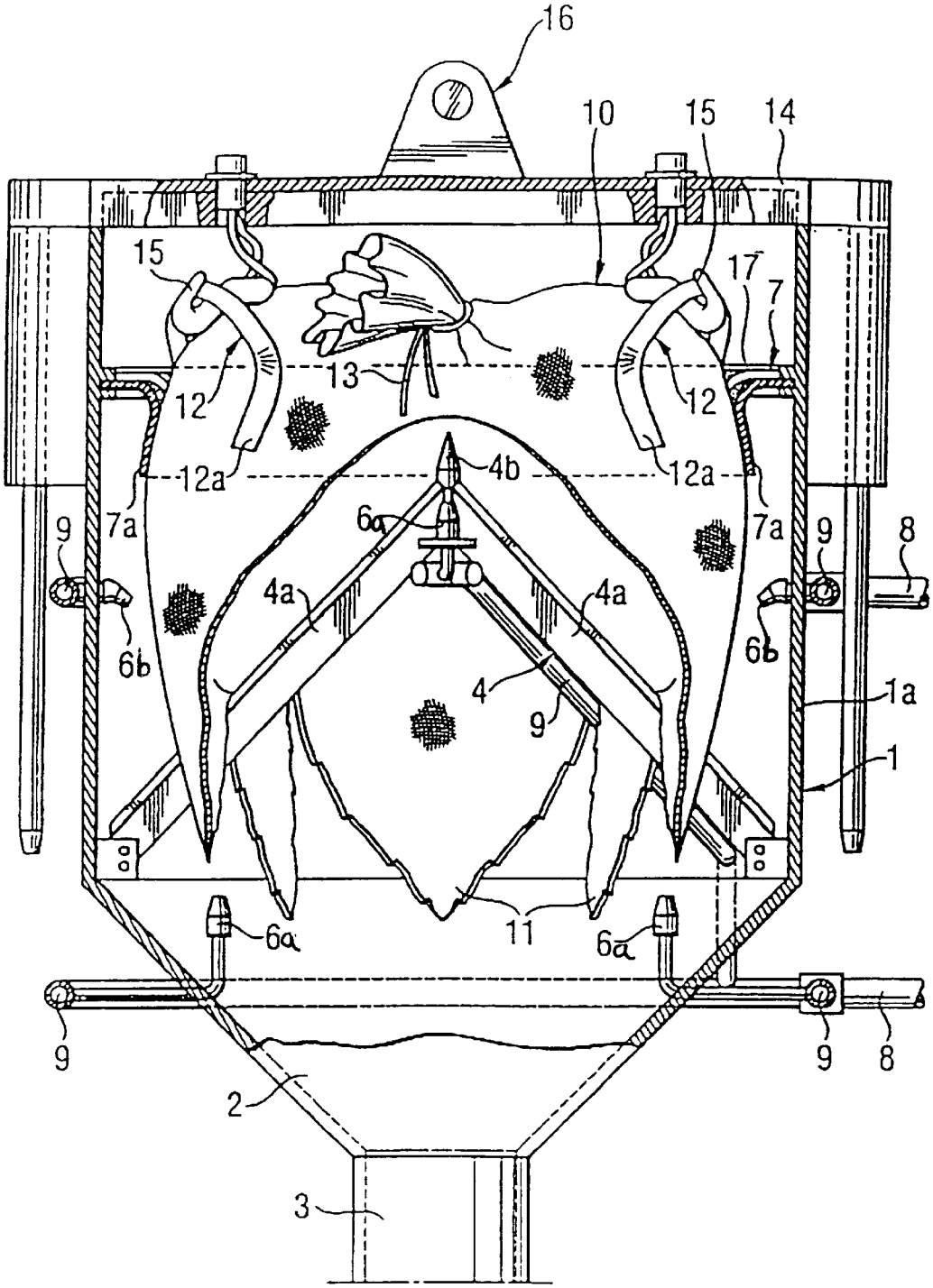
FIG. 3 shows a longitudinal sectional view taken along plane III—III of FIG. 2, showing the emptying station in a closed state with a bulk bag received in the receptacle body, wherein pyramid cutters of the emptying station are positioned inside a bulk bag and triangular flaps of the bulk bag formed by a cutting-open procedure hang downwards.

Operation of the emptying station to empty a bulk bag 10 according to the invention is described with reference to FIG. 3. As described above, prior to introduction of the bulk bag 10 into the receptacle body 1, the bulk bag 10 is suspended by its suspenders 12 from the hooks 15 of the top closure 14. (Although not shown, the top closure 14 is in turn carried by the carrier device 16.) The carrier device 16 and top closure 14 are manipulated to a position above the opening of the receptacle body 1, then are lowered until the bulk bag 10 is received in the receptacle body 1. As the bulk bag 10 enters into the receptacle body 1 and reaches the sealing structure 7, the sealing structure 7 is pressed downward by contact with the bulk bag 10 and the gap between the side walls 1*a* and the bulk bag 10 is sealed, thereby preventing dust from escaping through the top opening. As the bulk bag 10 is lowered further, the weight of the filled bulk bag 10 causes the pin 4*b* to pierce the bottom of the bulk bag 10 and, upon further downward movement of the bulk bag 10, the pyramid cutters 4*a* to cut open the entire bottom face of the bulk bag 10. Simultaneous with or subsequent to the bottom of the bulk bag 10 being pierced by the pin 4*b* and cut open by the cutters 4*a,* the top closure 12, which appropriately takes the form of a lid, closes the receptacle body 1 formed by the side walls 1*a*.

The cut bottom of the bulk bag 10 takes the form of triangular flaps 11 due to the placement of the cutters 4*a*. The triangular flaps 11 formed by the cutting procedure drop downwards and allow discharge of the contents from the bulk bags 10 to commence. The contents drop into the funnel 2 and pass through the pipe connection 3 into a reactor (not shown) or other equipment designed to receive the bulk material. As the contents empty from the bulk bag 10, the top closure 12 continues to move downward with the bulk bag 10 until the top closure 12 seals the receptacle body 1. After emptying of the bulk bag 10, the bag 10 is rinsed by actuation of the nozzles 6, to which a liquid rinsing agent is supplied via the pipe connection 8 and the supply lines 9.

It is expedient for the rinsing agent to be a solvent or suspending agent in the intended reaction. The quantity of rinsing agent entering the reactor (or other equipment downstream from outlet 3) in the form of the liquid rinsing agent is accordingly taken into account when the reactor is filled with liquid agent. Rinsing of the inside of the bulk bag not only prevents potential hazards, such as may arise during disposal of an unrinsed bulk bag, but at the same time makes the material supplied in the bulk bag available to the desired reaction without loss of material. After emptying the bulk bag 10, if required the exterior of the bulk bag also can be cleaned by means of spray nozzles incorporated in the side walls 1*a* and/or on the top closure 12. Once the rinsing process is complete, the emptied and rinsed bulk bag 10 is withdrawn from the receptacle body 10 by means of the carrier device 16. If organic solvents are used for rinsing, it is expedient to blow air through the inside of the bulk bag 10 after rinsing thereof, to remove any solvent residues (not illustrated).

Figure 4:
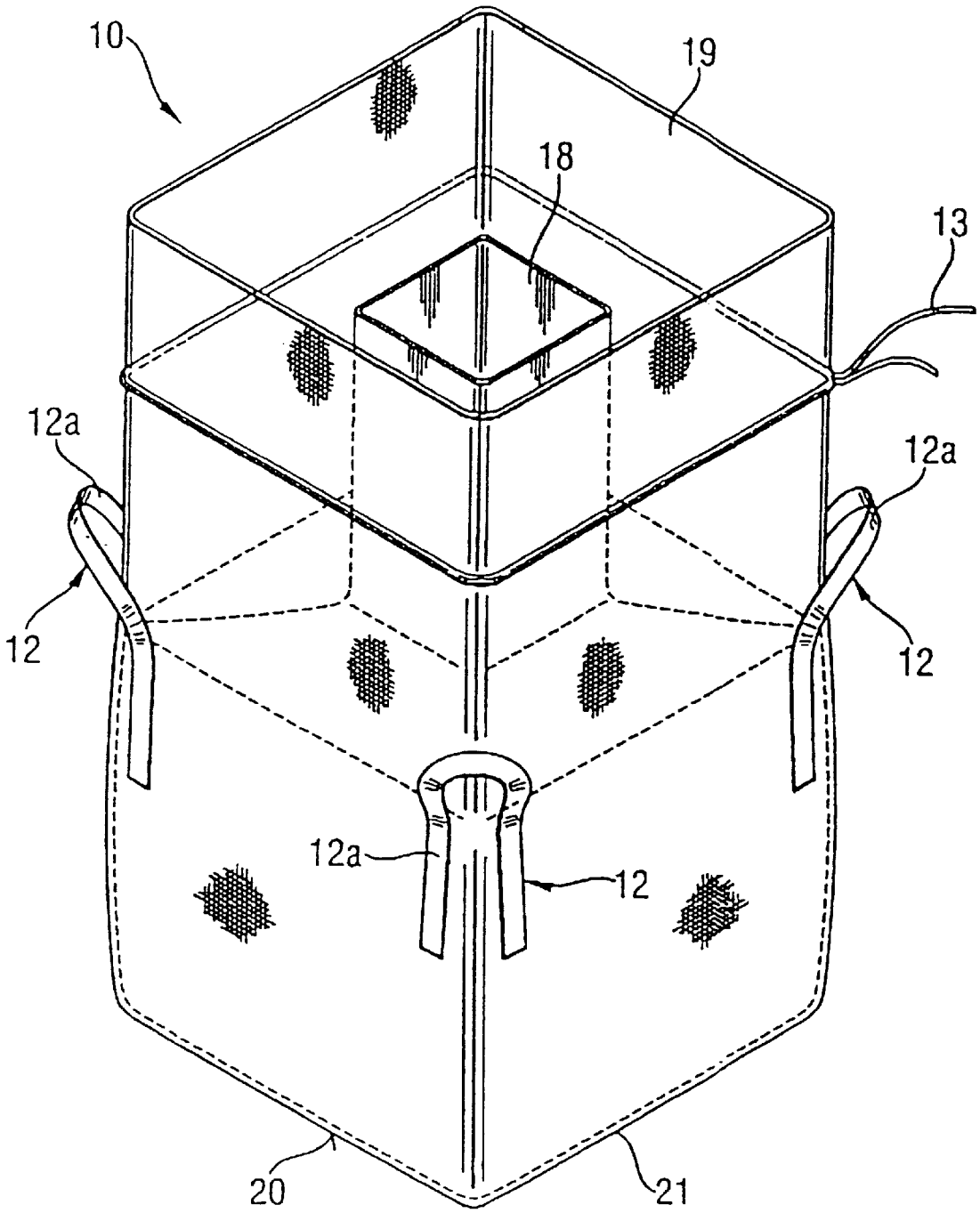
FIG. 4 shows a bulk bag with a square cross section and a flat bottom; the bulk bag comprises an inner sack and an outer sack together with holding straps.

Bulk bags 10, as shown in FIG. 4 and which are suitable for filling with hazardous materials, generally comprise an inner sack 18 and an outer sack 19. The inner sack 18 serves primarily to protect the bulk bag contents, but also should be sufficiently strong to hold the contents of the bulk bag 10. The outer sack 19 serves primarily to provide mechanical strength. The inner and outer sacks 18 and 19 are conventionally closed separately, by tying with tape 13 and/or other suitable means, such as adhesive or welding. Standard bulk bags 10 additionally comprise a plurality of suspenders 12, illustrated in FIG. 4 in the form of lifting straps 12*a*. The fixing seams 21 provide sufficient dimensional stability and strength to maintain the bottom 20 substantially flat.

The emptying station according to the invention is distinguished from known stations by the simplicity and reliability of its structure. Occupational hygiene problems arising hitherto during the handling of hazardous materials are prevented. The contents of the bulk bag are fed to a reactor or other equipment through the outlet without loss of materials, since dust and the like are contained. Although not limited to any particular use, the emptying station according to the invention may be used for emptying bulk bags filled with cyanuric chloride, in which case water is preferably used as the rinsing agent, since many reactions involving cyanuric chloride are performed in the presence of water.

The foregoing detailed description of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Modifications and equivalents will be apparent to practitioners skilled in this art and are encompassed within the spirit and scope of the appended claims.

What is claimed is:

1. A bulk-bag emptying station for emptying contents of bulk bags having suspenders, said emptying station comprising:

a bulk-bag receptacle body comprising side walls, said receptacle body having a sufficient height to receive a bulk bag and suspenders thereof and a sufficient volume to leave gaps between inner surfaces of said side walls and the bulk bag when received therein, said receptacle body having a top opening configured to receive the bulk bag and a bottom outlet for discharging contents emptied from the bulk bag;

a bulk-bag cutting subassembly accommodated in said receptacle body and comprising at least three cutters and a puncture pin, said cutters each having an associated blade facing upwards and collectively being arranged to define a pyramid having an apex, with said puncture pin positioned at said apex to point upwardly;

a guided top closure raisable into a receiving state in which said top closure is spaced from said receptacle body and lowerable into a closed state in which said top closure is received by said top opening, said top closure being engageable with the suspenders of the bulk bag so that raising and lowering of said top closure moves the bulk bag, when engaged to said top closure, out of and into contact with said bulk bag cutting subassembly; and a flexible sealing structure positioned on said inner surfaces of said side walls of said receptacle body for permitting sealing of the gaps formed between said side walls and the bulk bag when the bulk bag is received in said receptable body.

2. An emptying station according to claim 1, wherein said top closure further comprises a carrier device from which said top closure is suspendable.

3. An emptying station according to claim 1, further comprising one or more spray nozzles positioned inside said pyramid and one or more supply lines for supplying a rinsing agent to said spray nozzles.

4. An emptying station according to claim 3, wherein at least one of said spray nozzles is arranged in a upper half of said pyramid between two of said cutters, with an apex of said at least one of said spray nozzles being below an imaginary plane in which said associated blades of said two cutters lie.

5. An emptying station according to claim 3, further comprising one or more external spray nozzles positioned inside said receptacle body, yet outside of said pyramid.

6. An emptying station according to claim 1, wherein the side walls of said receptacle body collectively form a box with a rectangular or square cross section.

7. An emptying station according to claim 6, wherein the sealing structure comprises flexible plates, with each of said side walls having at least one of said flexible plates fixed thereto.

8. An emptying station according to claim 6, wherein said cutting subassembly is disposed at a base of said box so as to rest in a lowest quarter of said box.

9. An emptying station according to claim 8, wherein said emptying station contains four of said cutters, and wherein each of said cutters extends from a respective lower corner of said box to said apex.

10. An emptying station according to claim 9, wherein said pyramid has a height that is 0.5 to 2 times the width of the widest of said side walls.

11. An emptying station according to claim 1, wherein said receptacle body further comprises a funnel above said outlet, said outlet comprises a pipe connected centrally to a lower end of said funnel.

12. A process for emptying in an emptying station a single- or multi-ply bulk bag having a substantially flat bottom and suspenders, said process comprising:

providing the emptying station, the emptying station comprising a bulk-bag receptacle body including side walls and having a top opening and bottom outlet, a bulk-bag cutting subassembly accommodated in the receptacle body and comprising at least three cutters and a puncture pin, a guided raisable and lowerable top closure, and a flexible sealing structure positioned on the inner surfaces of the side walls of the receptacle body, wherein the cutters each have an associated blade facing upwards and the cutters are collectively arranged to define a pyramid having an apex, with the puncture pin positioned at the apex to point upwardly;

coupling the suspenders of the bulk bag to the top closure;

lowering the top closure and the bulk bag coupled thereto to pass the bulk bag into the receptacle body and cause the substantially flat bottom of the bulk bag to be pieced by the puncture pin and cut by the blades of the cutters for emptying contents from the bulk bags to the bottom outlet, wherein the sealing structure seals gaps formed between inner surfaces of the side walls and the bulk bag to prevent dust from escaping through the top opening; and continuing lowering of the top closure until the top closure is positioned in a closed state in which the top closure is received in the top opening.

13. A process according to claim 12, wherein the bulk bag comprises an inner sack and an outer sack.

14. A process according to claim 12, wherein the emptying station further comprises one or more spray nozzles positioned inside said pyramid and one or more supply lines for supplying a rinsing agent to the spray nozzles, and wherein said process further comprises spraying the rinsing agent from the spray nozzles and rinsing the inside of the emptied bulk bag with the rinsing agent sprayed from the spray nozzles.

15. A process according to claim 14, further comprising raising the top closure and the emptied bulk bag coupled thereto and removing the emptied bulk bag from the receptacle body.

16. A process according to claim 14, wherein the emptying station further comprises outer spray nozzles positioned in the receptacle body, yet outside the pyramid, and wherein said process further comprises, subsequent to said rinsing of the inside of the emptied bulk bag, rinsing off the outside of the bulk bag with the rinsing agent sprayed from the outer spray nozzles.

* * * * *